US010967633B2

(12) United States Patent
Yokota

(10) Patent No.: US 10,967,633 B2
(45) Date of Patent: Apr. 6, 2021

(54) RECORDING DEVICE

(71) Applicant: SEIKO EPSON CORPORATION, Tokyo (JP)

(72) Inventor: So Yokota, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/368,328

(22) Filed: Mar. 28, 2019

(65) Prior Publication Data

US 2019/0299598 A1 Oct. 3, 2019

(30) Foreign Application Priority Data

Mar. 29, 2018 (JP) ..... JP2018-063854

(51) Int. Cl.
*B41J 2/045* (2006.01)
*B41J 29/393* (2006.01)

(52) U.S. Cl.
CPC ..... *B41J 2/04558* (2013.01); *B41J 29/393* (2013.01)

(58) Field of Classification Search
CPC . B41J 3/60; B41J 29/388; B41J 29/393; B41J 2029/3935; B41J 11/46
See application file for complete search history.

(56) References Cited

U.S. PATENT DOCUMENTS

2011/0234672 A1* 9/2011 Ohtsu ..... B41J 3/60 347/14
2015/0273896 A1* 10/2015 Koizumi ..... B41J 2/04573 347/10
2018/0236789 A1 8/2018 Yokota
2018/0370253 A1* 12/2018 Ohnishi ..... B41J 11/46

FOREIGN PATENT DOCUMENTS

JP 2010-012757 A 1/2010
JP 2018-130918 A 8/2018

* cited by examiner

*Primary Examiner* — Scott A Richmond
(74) *Attorney, Agent, or Firm* — Chip Law Group

(57) ABSTRACT

In a printer configured to perform two-sided recording, a control unit generates a first correspondence relationship that associates a reference pattern with raster data of a first image in a medium transport direction, and a second correspondence relationship that associates the reference pattern with raster data of a second image in the medium transport direction, and, when the second image is recorded on a second surface, performs determination processing for determining whether the reference pattern detected by a detection unit and the raster data of the second image, which a recording unit records when the reference pattern is detected, match the second correspondence relationship.

8 Claims, 10 Drawing Sheets

RECORDING DEVICE

The present application is based on, and claims priority from JP Application Serial Number 2018-063854, filed Mar. 29, 2018, the disclosure of which is hereby incorporated by reference herein in its entirety.

BACKGROUND

1. Technical Field

The present disclosure relates to a recording device for recording on both sides of a medium.

2. Related Art

In a recording device represented by an ink jet printer, for example, after recording on a first surface as a front surface, recording on a second surface as a rear surface of the first surface is performed in some cases. Note that, the above recording is referred to as duplex recording in the following.

Here, in a case in which a medium is subject to duplex recording, and when viewed from one surface (e.g., a first surface), an image on the other surface (e.g., a second surface) is seen through in some cases. In this case, when an image formed on the first surface of the medium and an image formed on the second surface are deviated from each other, and the image is viewed from one side, a user may sense deviation because the image showing through the second surface blurs an outline of the image on the first surface, or the like, in some cases.

In order to avoid recording deviation between the image on the first surface and the image on the second surface, a method has been adopted in which, an image is recorded on the first surface of the medium being transported, and a plurality of markers for detection is formed at predetermined intervals in a medium transport direction, and when recording is performed on the second surface, while the markers for detection are read by a sensor or the like, positions of the image on the first surface and the image on the second surface are matched based on positions of the markers for detection.

Meanwhile, along with the recording of the image on the first surface, partial expansion/contraction of the medium may occur. In this case, the image itself to be recorded on the second surface may need to be corrected.

When correction of the image to be recorded on the second surface is necessary, based on the intervals between the plurality of markers for detection, by thinning image data, or the like, adjustment is performed such that the recorded image has a desired size.

For example, JP-A-2010-12757 discloses a method in which, in a case in which duplex recording (double-sided printing) is performed with a printer, when an image is recorded (printed) on a first surface (e.g., a front surface in JP-A-2010-12757), a plurality of markers for detection (expansion/contraction detection lines 31a to 31e in JP-A-2010-12757) is formed on the first surface, and when recording is performed on a second surface (e.g., a rear surface in JP-A-2010-12757), an expansion/contraction amount of a medium is obtained based on the intervals between the plurality of markers for detection, and the second surface is corrected.

In JP-A-2010-12757, for example, when an interval between the adjacent markers for detection (hereinafter, referred to as a marker interval) on the medium in a state of not expanded/contracted is set to 100 mm, and it is detected that an actual marker interval is 99 mm, that is, the interval is 1 mm shorter than an interval set preceding recording, then, by recording an image 1 mm longer in subsequent recording, a length of the entire image is set to a specified value. Thus, a recording complete position of the image on the first surface (a rear end position in a medium transport direction) and a recording complete position on the second surface can be matched.

However, in the configuration in which the length of the image on the second surface is determined based on the expansion/contraction amount of the medium obtained from the intervals between the plurality of markers for detection, there is a problem as follows.

In other words, when a reading error occurs while the marker intervals are read, the errors of the marker intervals are accumulated from a front end side to a rear end side of the image, and thus there is a possibility that deviation occurs in the length of the entire image to be corrected.

SUMMARY

An advantage of some aspects of the disclosure is, in a recording device for performing duplex recording, to appropriately perform position matching of an image recorded on a first surface and an image recorded on a second surface.

A recording device according to a first aspect of the disclosure is a recording device configured to perform recording on both a first surface of a medium to be transported, and a second surface being an opposite surface to the first surface, and includes a recording unit configured to perform recording on the medium, a detection unit configured to detect, when the recording unit records a second image on the second surface, a reference pattern formed on the first surface when the recording unit records a first image on the first surface, and a control unit configured to control the recording unit, wherein the control unit is configured to generate a first correspondence relationship that associates the reference pattern with raster data of the first image in a medium transport direction, and a second correspondence relationship that associates the reference pattern with raster data of the second image in the medium transport direction, and configured to, when the second image is recorded on the second surface, perform determination processing for determining whether the reference pattern detected by the detection unit and the raster data of the second image, which the recording unit records when the reference pattern is detected, match the second correspondence relationship.

According to the aspect, the control unit generates the first correspondence relationship that associates the reference pattern with the raster data of the first image in the medium transport direction, and the second correspondence relationship that associates the reference pattern with the raster data of the second image in the medium transport direction and when the second image is recorded on the second surface, performs the determination processing for determining whether the reference pattern detected by the detection unit and the raster data of the second image, which the recording unit records when the reference pattern is detected, match the second correspondence relationship. Thus the control unit can determine whether a position of the first image recorded on the first surface and a position of the second image being recorded on the second surface are deviated from each other or not.

More specifically, in a case in which the second image is recorded on the second surface, and when the reference pattern detected by the detection unit and the raster data of the second image, which the recording unit records when the reference pattern is detected, match the second correspondence relationship, respective positions of the first image and the second image are determined to match. Otherwise, the respective positions of the first image and the second image are determined to be deviated from each other.

Since whether the respective positions of the first image and the second image are deviated from each other or not can be determined when the one reference pattern is detected, for example, as in the related art, a possibility that reading errors occur in reading the intervals between the plurality of markers for detection can be avoided, and position deviation of the second image with respect to the first image can be detected with high precision.

Accordingly, the precision of position matching of the second image with respect to the first image to be performed can be enhanced based on information of the position deviation obtained by the determination processing.

In a second aspect of the disclosure, the detection unit according to the first aspect is provided upstream of the recording unit in the medium transport direction.

According to the aspect, since the detection unit is provided upstream of the recording unit in the medium transport direction, the position deviation between the first image and the second image can be detected earlier than a case in which the detection unit is provided downstream of the recording unit in the medium transport direction.

In a third aspect of the disclosure, the control unit according to the first aspect or the second aspect, in the determination processing, in a case in which the second image is recorded on the second surface, and when determining that the reference pattern detected by the detection unit and the raster data of the second image, which the recording unit records when the reference pattern is detected, do not match the second correspondence relationship, is configured to perform correction control to correct a positional relationship between the first image and the second image.

According to the aspect, the control unit, when determining that, in the determination processing, in a case in which the second image is recorded on the second surface, the reference pattern detected by the detection unit, and the raster data of the second image, which the recording unit records when the reference pattern is detected, do not match the second correspondence relationship, performs the correction control for correcting a positional relationship between the first image and the second image, and thus can match the position of the second image with the position of the first image with high precision.

In a fourth aspect of the disclosure, according to the third aspect the correction control is performed by the control unit complementing or thinning the raster data of the second image, based on an amount of deviation of the raster data of the second image from the second correspondence relationship at a timing in which the determination processing is performed.

According to the aspect, since the correction control is performed, based on the amount of deviation of the raster data of the second image from the second correspondence relationship at the timing in which the determination processing is performed, by complementing or thinning the raster data of the second image, the deviated positional relationship between the first image and the second image can easily be corrected.

A fifth aspect of the disclosure, in addition to the third aspect, includes a transport unit configured to transport the medium, wherein the correction control is performed by the control unit changing an amount of transport of the medium by the transport unit, based on a deviation amount of the raster data of the second image from the second correspondence relationship at a timing in which the determination processing is performed.

According to the aspect, the correction control is performed, based on the amount of deviation of the raster data of the second image from the second correspondence relationship at the timing in which the determination is performed, by changing the amount of transport of the medium by the transport unit, and thus the deviated positional relationship between the first image and the second image can easily be corrected.

In a sixth aspect of the disclosure, in addition to the fourth aspect or the fifth aspect, the first image includes a preceding first image which is recorded first and a following first image which is recorded following the preceding first image, the second image includes a preceding second image for which a recording position is determined with respect to the preceding first image and which is recorded first, and a following second image for which a recording position is determined with respect to the following first image and which is recorded following the preceding second image, and the control unit is configured to, when the following second image is recorded, perform the correction control, based on the amount of deviation obtained from a result of the determination processing when the preceding second image is recorded.

According to the aspect, the control unit, when the following second image is recorded, performs the correction control based on the amount of deviation obtained from the determination processing when the preceding second image is recorded, and thus a possibility that the following second image is recorded while being deviated from the following first image can be reduced.

A seventh aspect of the disclosure, in addition to any one the first aspect through the sixth aspect, includes a support unit configured to support the medium at a position facing the recording unit, wherein the detection unit is provided at the support unit side.

According to the aspect, when the recording unit records the second image on the second surface, the detection unit can more accurately detect the reference pattern formed on the first surface.

DESCRIPTION OF EXEMPLARY EMBODIMENTS

First Exemplary Embodiment

Hereinafter, with reference to the figures, an ink jet printer 1 (merely referred to as a printer 1, in the following) as an example of a recording device of the disclosure will be described. The printer 1 is a recording device for recording by discharging ink on fabric as a medium P.

Note that, in an X-Y-Z coordinate system illustrated in each figure, an X direction is a moving direction of a recording head, and is a width direction of the device. Additionally, a Y direction is a transport direction of the medium P. Additionally, a Z direction is a gravity direction, and indicates a height direction of the device. Additionally, a +Z direction is an upward direction of the device (including an upper portion, an upper surface, or the like), a −Z direction side is a downward direction (including a lower portion, a lower surface, or the like).

Overview of Printer

Figure 1:
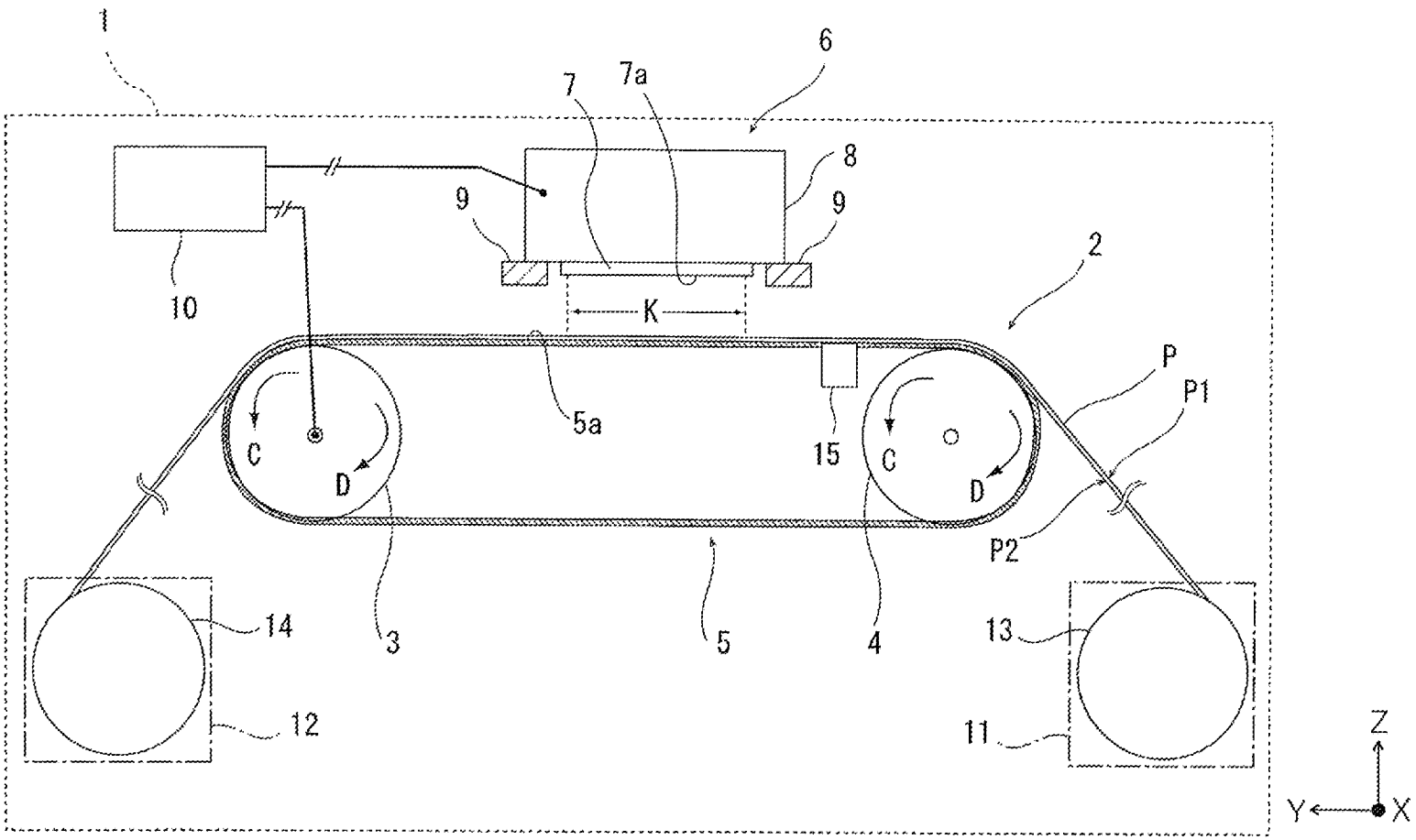
FIG. 1 is a schematic side view illustrating a printer according to the disclosure.
Figure 2:
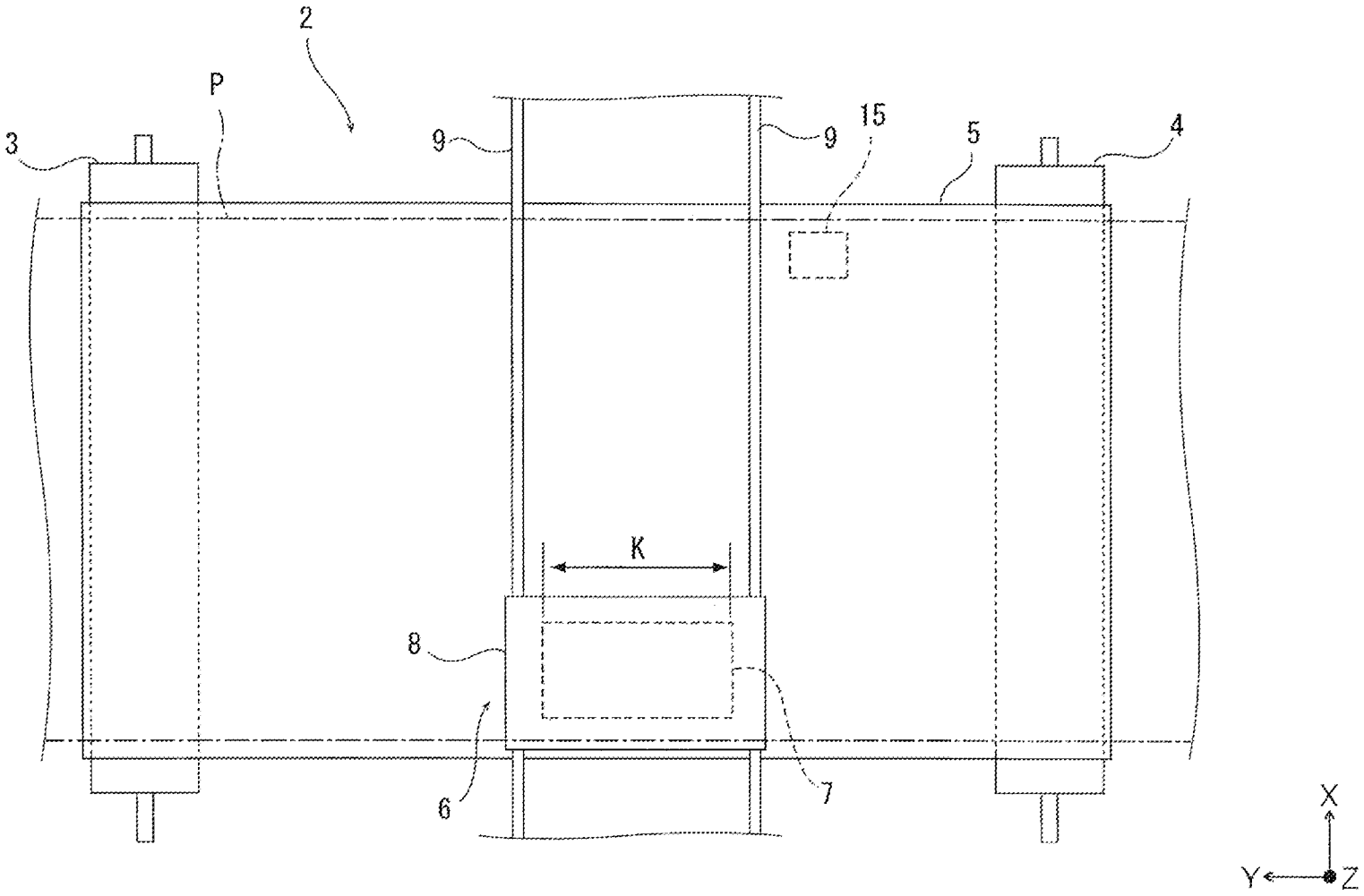
FIG. 2 is a schematic plan view illustrating a main section of the printer according to the disclosure.

The printer 1 of the exemplary embodiment illustrated in FIG. 1 includes, as an example, a transport unit 2 for transporting the medium P in the transport direction (+Y direction) with a transport belt 5 (see also FIG. 2). The transport belt 5 supports the medium P by a support surface 5*a* with an adhesive applied, and the transport unit 2 transports the medium P by rotating the transport belt 5.

In the exemplary embodiment, the support surface 5*a* is a support unit for supporting the medium P at a position facing a recording unit 6 described later.

The printer 1 is provided with an unreeling unit 11 to which roll shaped medium P can be set and that can unreel the medium P wound around a first winding roller 13 onto the transport belt 5 of the transport unit 2. Note that, a transport method of the medium P is not limited to one using the transport belt 5. A configuration may be adopted in which the medium P is pinched by a roller pair and applied with transport force.

As the medium P to be used in the printer 1, for example, fabrics such as cotton, silk, wool, chemical fibers, and blended fabrics, and paper media such as roll paper are included.

The transport unit 2 includes a first transport roller 3 to be driven by an unillustrated driving source, a second transport roller 4 disposed at an interval from the first transport roller 3, and the transport belt 5 bridged over the first transport roller 3 and the second transport roller 4. In the exemplary embodiment, the second transport roller 4 is a driven roller that rotates following rotation of the first transport roller 3. However, the second transport roller 4 may be a driving roller to be driven by a driving source as in the case of the first transport roller 3.

Operation of the first transport roller 3 is controlled by a control unit 10, and thus operation of the transport unit 2 is controlled.

The transport belt 5 is an endless belt. The transport belt 5 can be formed with an elastic material such as rubber or resin, and can be formed with a metal material as well.

Further, in a configuration of the transport belt 5 in the exemplary embodiment, the medium P is pasted on the transport belt 5 by an adhesive, but the transport belt 5 is not limited to the configuration. For example, a configuration may be adopted in which the medium P is pasted on the transport belt 5 by an electrostatic adsorption method or a suction adsorption method.

Additionally, in order that the transport belt 5 allows light emitted from a detection unit 15 described later to pass through, a portion facing the detection unit 15 of the transport belt 5 is configured with a light transmissive material.

Note that, in a case of a configuration in which the medium P is pinched by a roller pair and applied with transport force, a platen is usable as a support unit. In this case, the platen may be configured to be formed with an opening, and transmit light emitted from the detection unit 15 through the opening.

The first transport roller 3 is rotatably configured in a first rotation direction C as illustrated in FIG. 1. The second transport roller 4 that rotates following the first transport roller 3 is also rotatably configured in the first rotation direction C.

Rotating the first transport roller 3 in the first rotation direction C rotates the transport belt 5 in the first rotation direction C as well. At this time, the support surface 5*a* moves in the +Y direction, and the medium P supported by the support surface 5*a* is transported in the +Y direction. The +Y direction is the transport direction of the medium P when recording is performed on the medium P with a recording head 7. Note that, the first transport roller 3 and the second transport roller 4 are also rotatably configured in a second rotation direction D opposite to the first rotation direction C, and rotating the first transport roller 3 in the second rotation direction D moves the support surface 5*a* in a −Y direction.

Further, the printer 1 includes the recording unit 6 for recording on the medium P supported and transported by the support surface 5*a* of the transport belt 5. The recording unit 6 is configured to include the recording head 7 for discharging ink (liquid), and a carriage 8 capable of reciprocating in the width direction (an X axis direction) intersecting with the transport direction (+Y direction) of the medium P while holding the recording head 7. The carriage 8, as illustrated in FIG. 2, moves along a guide rail 9 extending along the width direction.

The recording head 7 discharges ink from a liquid discharging surface 7*a*, and records on the medium P transported below the liquid discharging surface 7*a*. Note that, in FIG. 1, a region denoted by a sign K is a recording region by the recording head 7 (recording unit 6).

The printer 1 of the exemplary embodiment, when recording, reciprocates the carriage 8 including the recording head 7 in the X axis direction to record, but in recording (while the carriage 8 is moving), the transport unit 2 stops transporting the medium P. In other words, during the recording, the reciprocation of the carriage 8 and the transportation of the medium P are repeatedly performed. That is, corresponding to the reciprocation of the carriage 8, the transport unit 2 intermittently transports the medium P (intermittently moves the transport belt 5).

The recording unit 6 may also be a line-head type, capable of discharging liquid along the width direction (X axis direction) of the medium P without reciprocating the recording head in the X axis direction.

The recording unit 6 is controlled by the control unit 10. More specifically, the control unit 10 controls an ink discharging operation from the recording head 7 and a moving operation of the carriage 8. Note that, the control unit 10 controls the recording unit 6 and the above-described first transport roller 3, and additionally, controls operations of various components to be driven in the printer 1.

Further, a configuration is adopted in which, the medium P after being recorded by the recording head 7, in a winding unit 12 provided at the downstream side of the first transport roller 3 in the transport direction, is wound as a roll shape around a second winding roller 14.

The printer 1 is configured to be capable of performing duplex recording in which recording is performed on both a first surface P1 of the transported medium P (a surface facing upward in FIG. 1) and a second surface P2 being an opposite surface to the first surface (a surface facing downward in FIG. 1). FIG. 1 illustrates a state in which the first surface P1 faces the liquid discharging surface 7*a* of the recording head 7, and recording on the first surface P1 is enabled.

In a case in which after completion of the recording on the first surface P1, recording on the second surface P2 is performed, the medium P is once wound around the first winding roller 13 again. Additionally, the first winding roller 13, and the second winding roller 14 are taken out from the unreeling unit 11 and the winding unit 12, respectively, and the medium P is inverted, and the first winding roller 13 and the second winding roller 14 are mounted on the unreeling unit 11 and the winding unit 12 again, respectively.

This leads to a state in which the second surface P2 faces the liquid discharging surface 7*a* of the recording head 7, and recording on the second surface P2 is enabled.

Here, when images are to be recorded on both the first surface P1 and the second surface P2, there is a need by a user that, with respect to an image recorded on the first surface P1 (referred to as a first image A in the following), a position of an image to be recorded on the second surface P2 (referred to as a second image B in the following) desirably has a predetermined positional relationship.

For example, when the medium P subjected to duplex recording is used as a vertical flag or a hanging banner, and is viewed from one surface side, an image on the other surface side shows through, and thus respective recording start positions and recording end positions in the medium transport direction (a Y axis direction, referred to as a medium transport direction Y in the following) of the first image A and the second image B are desirably aligned in some cases.

The printer 1 is configured such that the control unit 10 can perform the determination processing for determining whether the second image B is recorded at a desired position with respect to the first image A in the medium transport direction Y.

After the detection unit 15 used for performing the determination processing performed by the control unit 10 and a reference pattern 20 detected by the detection unit 15 are described, the determination processing performed by the control unit 10 will be described in the following.

About Detection Unit and Reference Pattern

In the printer 1, the detection unit 15 is provided at the upstream side (−Y side) of the recording unit 6 in the medium transport direction Y.

Figure 3:
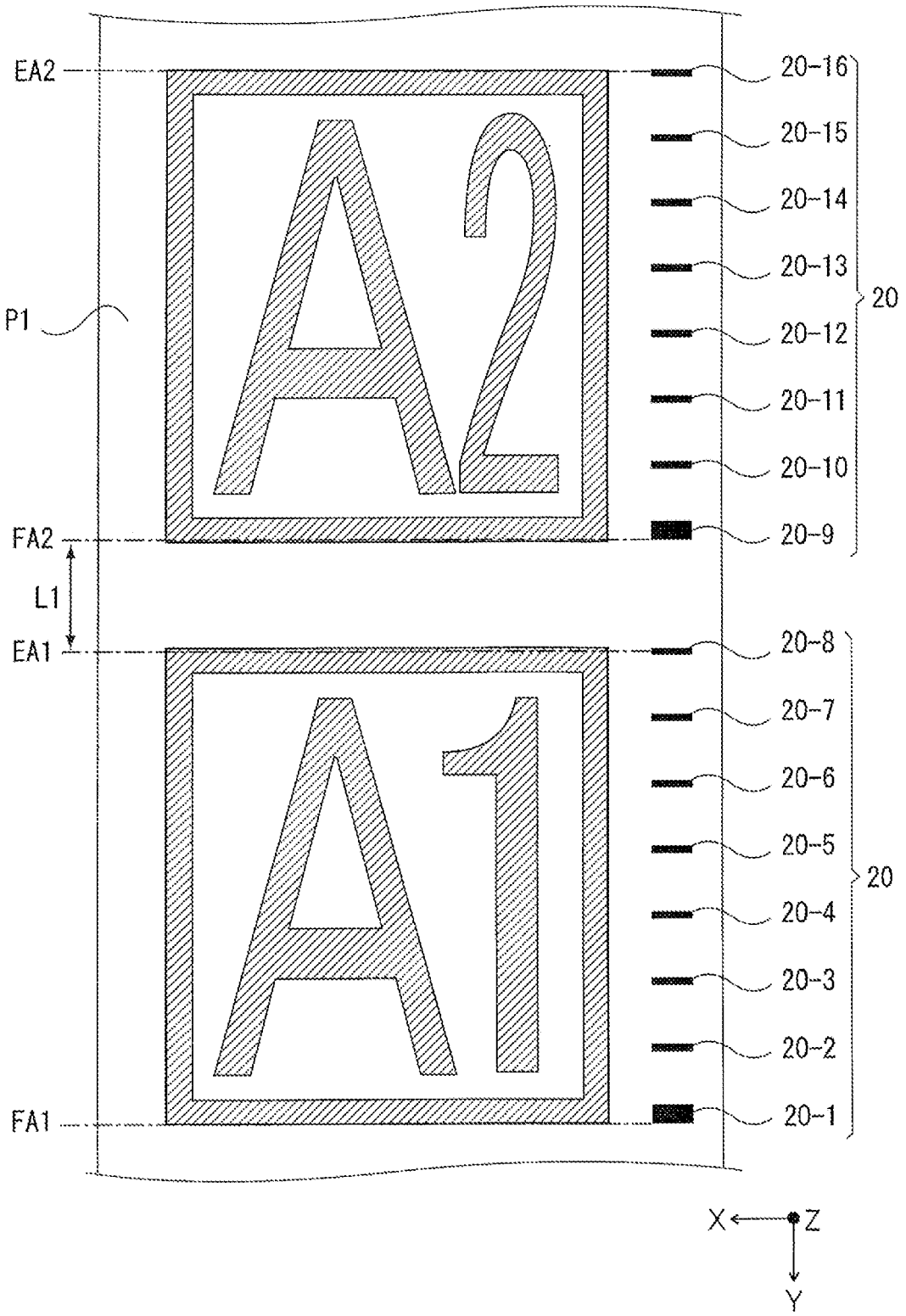
FIG. 3 is a schematic plan view of a first surface of a medium with a first image recorded.

The detection unit 15 detects the reference pattern 20 formed on the first surface P1 when the recording unit 6 records the first image A on the first surface P1 (FIG. 3), when the recording unit 6 records the second image B on the second surface P2. In the exemplary embodiment, the reference pattern 20 is formed, by the recording unit 6, on one end side in the width direction intersecting with the medium transport direction Y (X axis direction, referred to as a width direction X). In FIG. 3, the reference pattern 20 is formed on the −X side.

The reference pattern 20 will be described with reference to FIG. 3 and FIG. 4.

On the first surface P1 illustrated in FIG. 3, as the first image A, a preceding first image A1 recorded in advance, and a following first image A2 recorded following the preceding first image A1 are recorded.

The reference pattern 20 is configured with a plurality of patterns 20-1 to 20-16 formed at intervals in the medium transport direction Y.

As for the reference pattern 20, firstly, the pattern 20-1 is formed at a position corresponding to a front end FA1 of the preceding first image A1 in the medium transport direction Y, and at each predetermined interval from the pattern 20-1, next patterns 20-2, 20-3, 20-4, . . . and 20-8 are formed. The pattern 20-8 corresponds to a rear end EA1 of the preceding first image A1. Note that, FIG. 3 is a diagram of the first surface P1 in a plan view from the recording unit side.

The following first image A2 is formed at an interval by a distance L1 from the rear end EA1 of the preceding first image A1. With a position at an interval having the distance L1 from the rear end EA1 being a front end FA2 of the following first image A2, the pattern 20-9 is formed at a position corresponding to the front end FA2. At each predetermined interval from the pattern 20-9, next patterns 20-10, 20-11, 20-12, . . . , 20-16 are formed. The pattern 20-16 corresponds to a rear end EA2 of the following first image A2.

Figure 4:
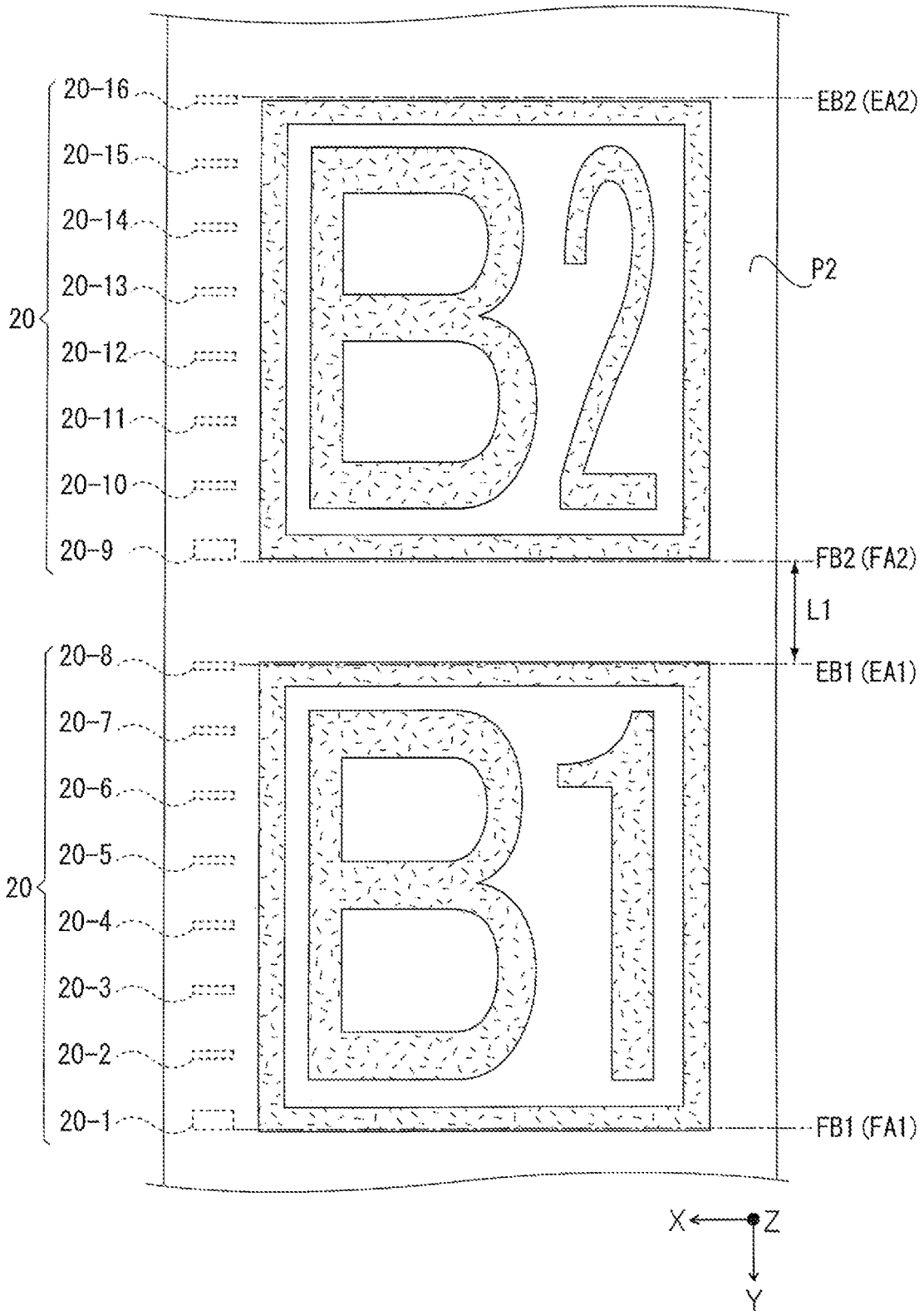
FIG. 4 is a schematic plan view of a second surface of the medium with a second image recorded.

In FIG. 4, the second image B to be recorded on the second surface P2 is illustrated. The second image B contains a preceding second image B1 to be recorded in advance, and a following second image B2 to be recorded following the preceding second image B1.

In the exemplary embodiment, as an example, a case will be described in which, a rectangular outer border of the preceding second image B1 has an identical size to that of the preceding first image A1 (FIG. 3), and the first image A1 overlaps the outer border. Further, similarly, a rectangular outer border of the following second image B2 is recorded so as to overlap an outer border of the following first image A2 (FIG. 3). Note that, FIG. 4. is a diagram of the second surface P2 in a plan view from the recording unit side.

That is, in the medium transport direction Y, a front end FB1 of the preceding second image B1 is at an identical position to the front end FA1 of the preceding first image A1, and is recorded at a position corresponding to the pattern 20-1. Additionally, a rear end EB1 of the preceding second image B1 is at an identical position to the rear end EA1 of the preceding first image A1, and is recorded at a position corresponding to the pattern 20-8.

The following second image B2 is formed at an interval having the distance L1 from the rear end EB1 of the preceding second image B1. A front end FB2 of the following second image B2 is at an identical position to the front end FA2 of the following first image A2, and is recorded at a position corresponding to the pattern 20-9. A rear end EB2 of the following second image B2 is at an identical position to the rear end EA2 of the following first image A2, and is recorded at a position corresponding to the pattern 20-16.

The detection unit 15, as an example, can use a light sensor including a light emitting unit (not illustrated) for emitting light, and a light receiving unit (not illustrated) for receiving reflected light of light emitted from the light emitting unit.

The light sensor as the detection unit 15 detects the reference pattern 20 according to a difference in intensity of reflected light between a background color portion of the medium P and the reference pattern 20.

Note that, of the reference pattern 20, the pattern 20-1 formed at the position corresponding to the front end FA1 of the preceding first image A1 and the pattern 20-9 formed at the position corresponding to the front end FA2 of the following first image A2 are formed so as to be longer than other patterns 20-2 to 20-8, and patterns 20-10 to 20-16 in the medium transport direction Y, and thus the respective positions of the front ends of images can be detected.

In the exemplary embodiment, the detection unit 15 is provided on a side of the support surface 5*a* (support unit) for supporting the medium P. Accordingly, when the recording unit 6 records the second image on the second surface P2, the detection unit 15 can detect the reference pattern 20 formed on the first surface P1 facing the side of the support surface 5*a*.

Note that, for example, when the medium P is a medium with high transparency such that the reference pattern 20 can be seen through a second surface P2 side, the reference pattern 20 can be detected by the detection unit 15 disposed on a recording unit 6 side.

Here, recording of the preceding second image B1 is started by the recording unit 6, with detection of the pattern 20-1 by the detection unit 15 being a trigger, after transportation of the medium P by a predetermined transport amount, that is, after transportation by a transport amount enough to put a position of the pattern 20-1 into a recording region K by the recording region 6 in the medium transport direction Y.

Accordingly, a position of the front end FA1 of the preceding first image A1 on the first surface P1 and a position of the front end FB1 of the preceding second image B1 on the second surface P2 can be aligned.

When the position of the front end FA1 of the preceding first image A1 and the position of the front end FB1 of the preceding second image B1 on the second surface P2 are aligned, theoretically, a position of the rear end EA1 of the preceding first image A1 and a position of the rear end EB1 of the preceding second image B1 are also supposed to be aligned, and respective positions of the following first image A2 and the following second image B2 are also supposed to be aligned.

However, for example, after the preceding first image A1 and the reference pattern 20 are recorded, when drying processing for drying ink on the preceding first image A1 is performed, a portion of the medium P with the preceding first image A1 recorded shrinks in some cases.

Figure 5:
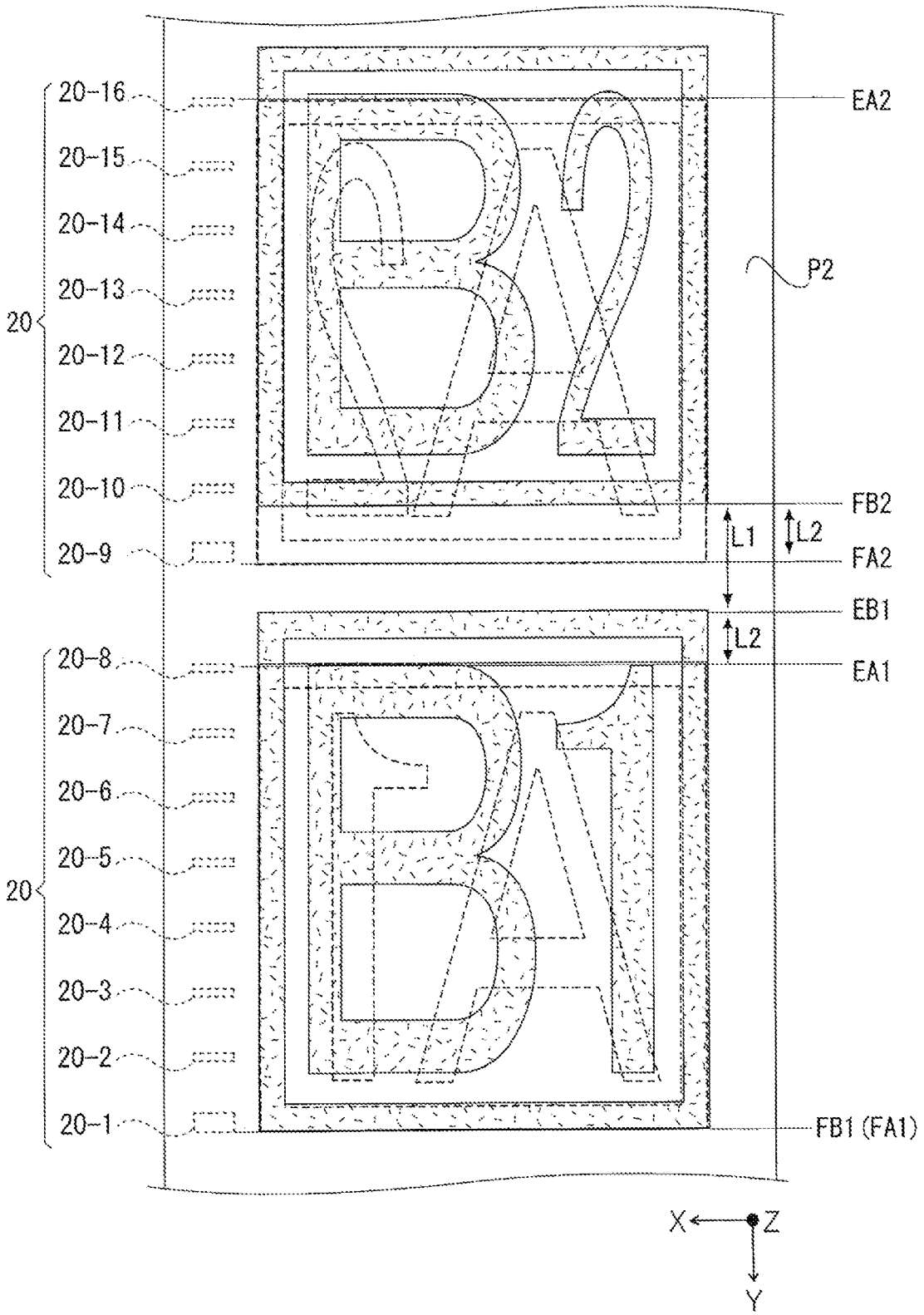
FIG. 5 is a diagram for explaining a state in which the second image on the second surface of the medium is deviated with respect to the first image on the first surface of the medium.

In a case in which the portion with the preceding first image A1 recorded shrinks, as illustrated in FIG. 5, even when the position of the front end FA1 of the preceding first image A1 and the position of the front end FB1 of the preceding second image B1 on the second surface P2 are aligned, the position of the rear end EA1 of the preceding first image A1 and the position of the rear end EB1 of the preceding second image B1 are deviated from each other in some cases. In FIG. 5, the rear end EB1 of the preceding second image B1 is positioned on the −Y side at a distance L2 with respect to the position of the rear end EA1 of the preceding first image A1.

Note that, FIG. 5 is a diagram of the second surface P2 in a plan view from the recording unit 6 side, and denotes the first image A (the preceding first image A1 and the following first image A2) in a state of being seen through the second surface P2 side as a dotted line.

In a case in which an interval between the rear end EB1 of the preceding second image B1 and a recording start position of the following second image B2 (front end FB2) is matched with an interval between the rear end EA1 of the preceding first image A1 and a recording start position of the following first image A2 (front end FA2) (the distance L1 in FIG. 5), when the position of the rear end EA1 of the preceding first image A1 and the position of the rear end EB1 of the preceding second image B1 are deviated from each other, the position of the front end FB2 of the following second image B2 is also deviated from the position of the front end FA2 of the following first image A2.

Further, for example, when the transport unit 2 transports the medium P in a state in which the second surface P2 faces the recording unit 6 side, the medium P cannot be transported appropriately due to slipping or the like, and thus the transport amount of the medium P varies in some cases. When the medium P slips, the transport amount decreases, and the rear end EB1 of the preceding second image B1 is positioned on a +Y side with respect to the position of the rear end EA1 of the preceding first image A1 in some cases.

Accordingly, in the exemplary embodiment, the control unit 10 performs the determination processing described later to detect deviation of the second image B with respect to the first image A.

About Determination Processing Performed by Control Unit

When duplex recording is performed, firstly, the control unit 10 generates, the first correspondence relationship in which the reference pattern 20 corresponds to raster data R of the first image A in the medium transport direction Y, and the second correspondence relationship in which the reference pattern 20 corresponds to raster data r of the second image B in the medium transport direction Y.

Figure 6:
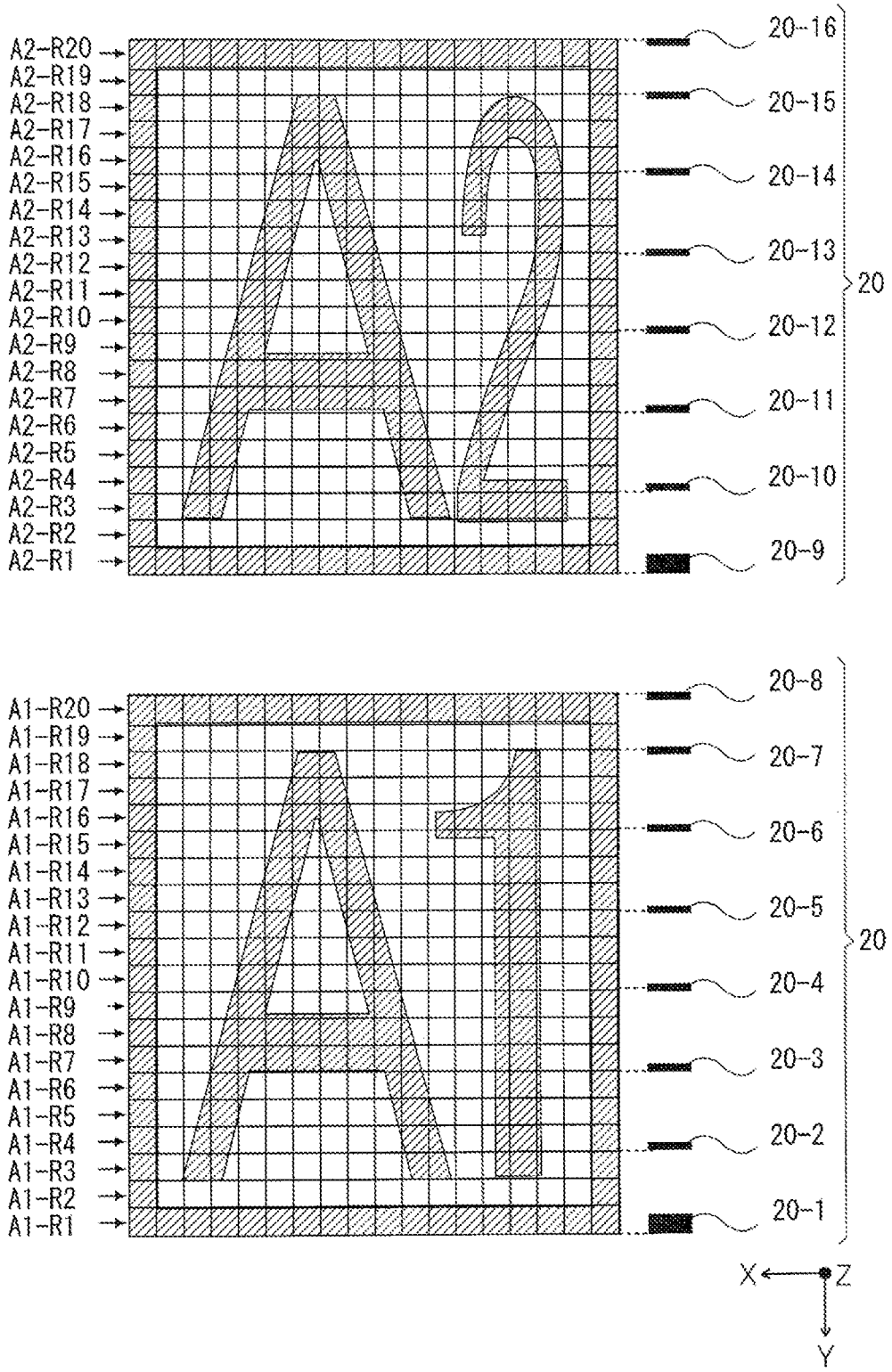
FIG. 6 is a diagram illustrating a relationship between a reference pattern and raster data of the first image.

FIG. 6 is a diagram in which the reference pattern 20 is associated with the raster data R of the first image A. In the first image A, the preceding first image A1 is, as an example, formed of the raster data R including 20 lines lined in the medium transport direction Y (raster data A1-R1 to A1-R20). Similarly, the following first image A2 is, formed of the raster data R including 20 lines lined in the medium transport direction Y (raster data A2-R1 to A2-R20).

Table 1 shows an example of the first correspondence relationship in which the reference pattern 20 illustrated in FIG. 6 is associated with the raster data R of the first image A.

TABLE 1

First correspondence relationship

| Reference pattern | Raster data R of first image |
|---|---|
| 20-1 | A1-R1 to A1-R3<br>(Start recording of preceding first image A1) |
| 20-2 | A1-R4 to A1-R6 |
| 20-3 | A1-R7 to A1-R9 |
| 20-4 | A1-R10 to A1-R12 |
| 20-5 | A1-R13 to A1-R15 |
| 20-6 | A1-R16 to A1-R18 |
| 20-7 | A1-R19 to A1-R20 |
| 20-8 | —<br>(End recording of preceding first image A1, secure non-recording region with distance L1) |
| 20-9 | A2-R1 to A2-R3<br>(Start recording of following first image A2) |
| 20-10 | A2-R4 to A2-R6 |
| 20-11 | A2-R7 to A2-R9 |
| 20-12 | A2-R10 to A2-R12 |
| 20-13 | A2-R13 to A2-R15 |

TABLE 1-continued

| First correspondence relationship | |
|---|---|
| Reference pattern | Raster data R of first image |
| 20-14 | A2-R16 to A2-R18 |
| 20-15 | A2-R19 to A2-R20 |
| 20-16 | — |
| | (End recording of following first image A2) |

After recording of the first image A and recording of the reference pattern 20 on the medium P, a relative position of the second image B with respect to the first image A is determined by associating the raster data r of the second image B with the reference pattern 20.

Figure 7:
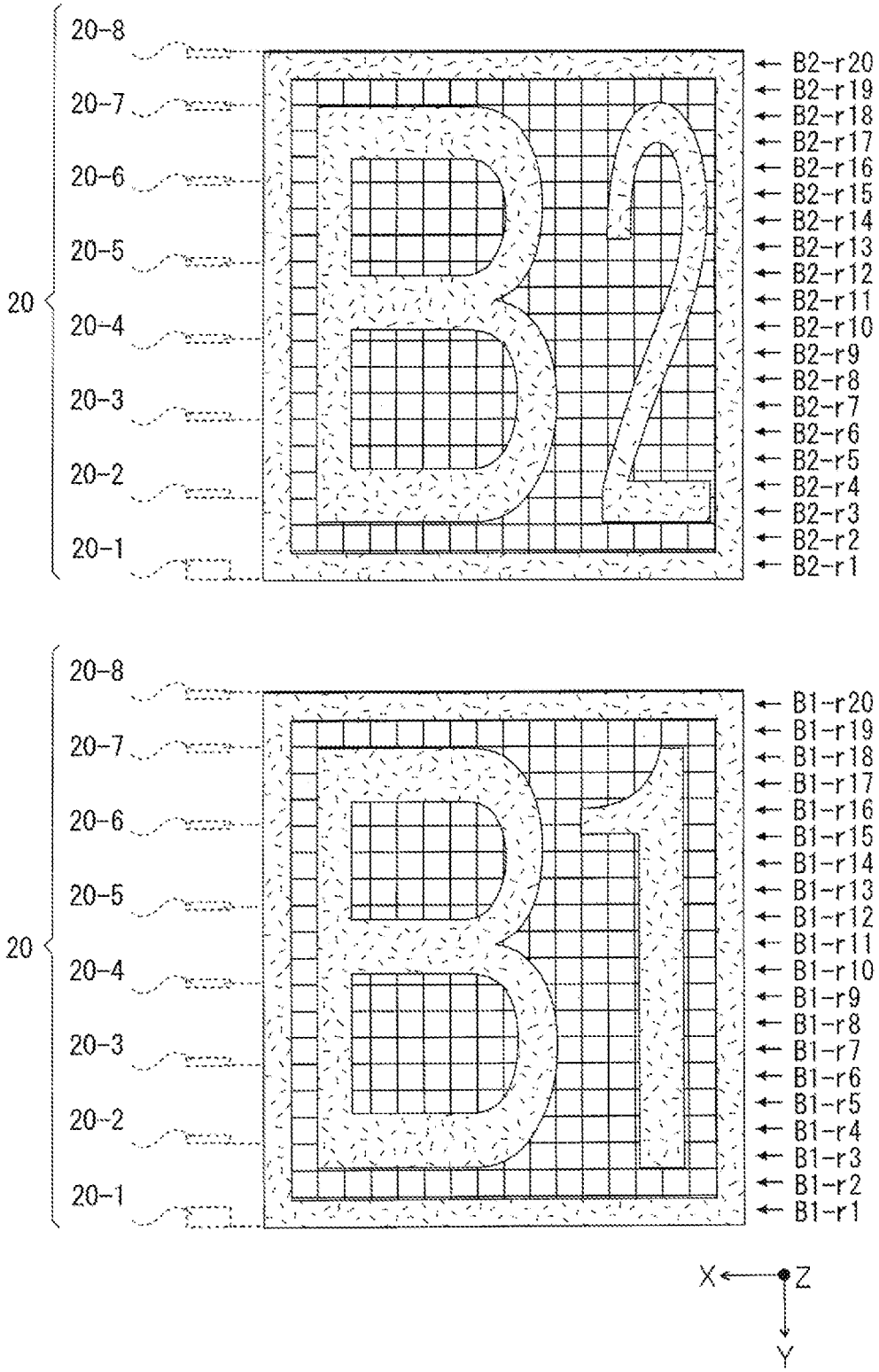
FIG. 7 is a diagram illustrating a relationship between a reference pattern and raster data of the second image.

As described above, in the exemplary embodiment, the first image A and the second image B are arranged so as to overlap each other. In FIG. 7, in the second image B that is a diagram associating the reference pattern 20 with the raster data r of the second image B, the preceding second image B1 is, as an example, formed of the raster data r including 20 lines lined in the medium transport direction Y (raster data B1-r1 to B1-r20). Similarly, the following second image B2 is, formed of the raster data r including 20 lines lined in the medium transport direction Y (raster data B2-r1 to B2-r20).

Table 2 shows an example of the second correspondence relationship in which the reference pattern 20 illustrated in FIG. 7 is associated with the raster data r of the second image B.

TABLE 2

| Second correspondence relationship | |
|---|---|
| Reference pattern | Raster data r of second image |
| 20-1 | B1-r1 to B1-r3 |
| | (Start recording of preceding second image B1) |
| 20-2 | B1-r4 to B1-r6 |
| 20-3 | B1-r7 to B1-r9 |
| 20-4 | B1-r10 to B1-r12 |
| 20-5 | B1-r13 to B1-r15 |
| 20-6 | B1-r16 to B1-r18 |
| 20-7 | B1-r19 to B1-r20 |
| 20-8 | — |
| | (End recording of preceding second image B1, secure non-recording region with distance L1) |
| 20-9 | B2-r1 to B2-r3 |
| | (Start recording of following second image B2) |
| 20-10 | B2-r4 to B2-r6 |
| 20-11 | B2-r7 to B2-r9 |
| 20-12 | B2-r10 to B2-r12 |
| 20-13 | B2-r13 to B2-r15 |
| 20-14 | B2-r16 to B2-r18 |
| 20-15 | B2-r19 to B2-r20 |
| 20-16 | — |
| | (End recording of following second image B2) |

The generated first correspondence relationship (Table 1) and the second correspondence relationship (Table 2) are stored in an unillustrated storage unit (memory).

Additionally, the control unit 10, after generating the first correspondence relationship and the second correspondence relationship, when recording the second image B on the second surface P2, performs the determination processing for determining whether the reference pattern 20 detected by the detection unit 15 and the raster data r of the second image B recorded by the recording unit 6 when the reference pattern 20 is detected match the second correspondence relationship.

Figure 8:
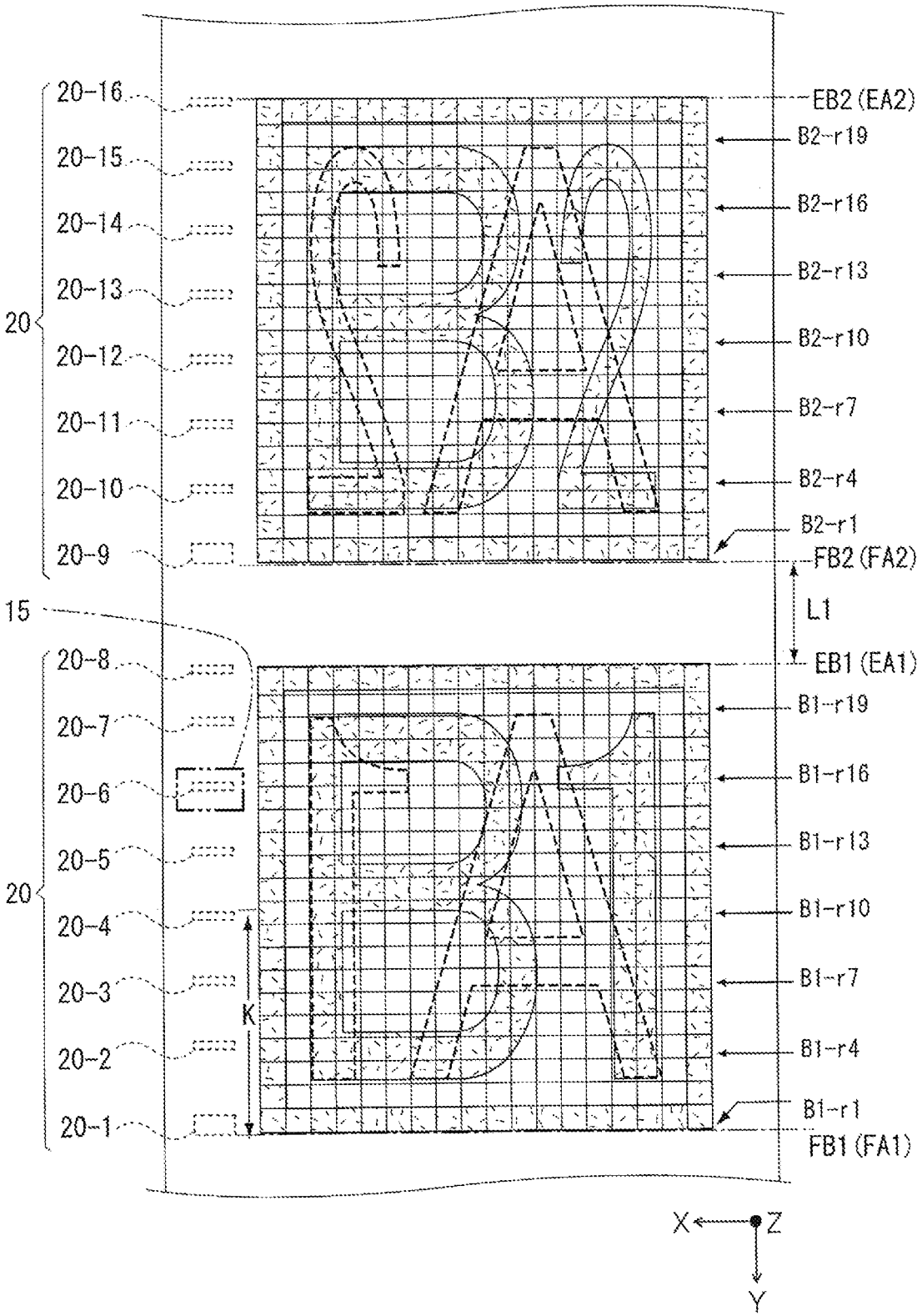
FIG. 8 is a diagram illustrating a state in which the second image on the second surface of the medium is recorded at a desired position with respect to the first image on the first surface of the medium.
Figure 9:
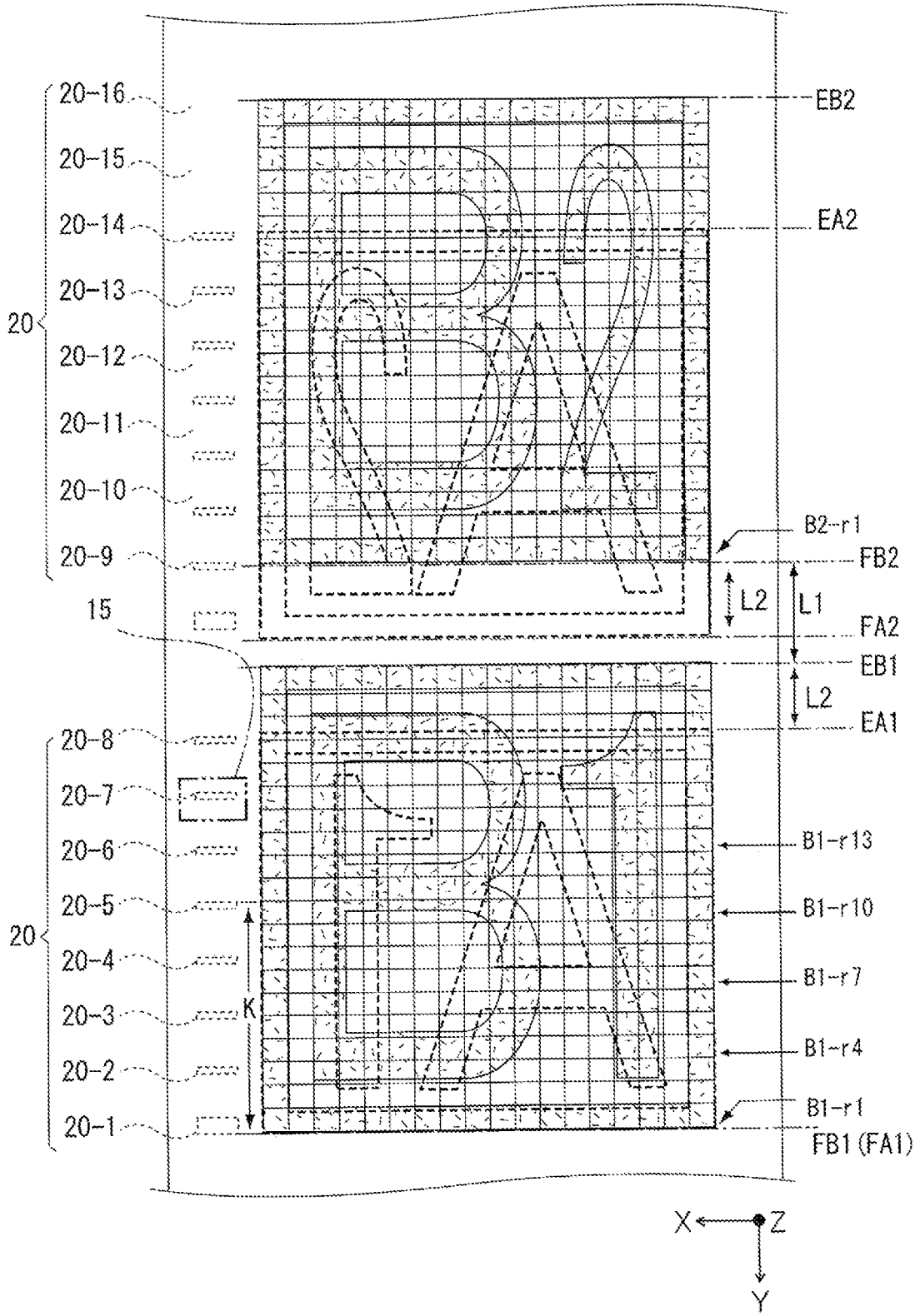
FIG. 9 is a diagram illustrating a state in which the second image on the second surface of the medium is recorded in a state of being deviated from the desired position with respect to the first image on the first surface of the medium.

With reference to FIG. 8 and FIG. 9, the determination processing performed by the control unit 10 will be described.

FIG. 8 illustrates a state in which the preceding second image B1 is recorded at a desired position on the second surface P2. Additionally, FIG. 8 illustrates a state in which a front end FB1 side of the preceding second image B1 is recorded in the recording region K, that is, a state in which the raster data B1-r1 to B1-r9 corresponding to the respective pattern 20-1 to the pattern 20-3 are recorded. At this time, in the detection unit 15, the pattern 20-6 is detected.

Note that, although illustration is omitted, when the state in FIG. 8 transits to a state in which the medium P is further transported and the pattern 20-7 is detected by the detection unit 15, and in the state, the raster data B1-r4 to B1-r12 corresponding to the respective pattern 20-2 to pattern 20-4 are recorded.

In a case of FIG. 8, when the control unit 10 records the preceding second image B1 (second image B) on the second surface P2, the reference pattern 20 detected by the detection unit 15 and the raster data r of the second image B recorded by the recording unit 6 when the reference pattern 20 is detected match the second correspondence relationship.

On the other hand, FIG. 9 illustrates a state in which, the preceding second image B1 is recorded on the second surface P2 of the medium P, in a state in which a portion on which the preceding first image A1 is recorded shrinks as a result of recording and drying of the preceding first image A1 on the first surface P1.

The shrinkage of the portion on which the preceding first image A1 is recorded narrows a plurality of intervals between adjacent patterns of the reference patterns 20. Thus, in the recording region K, when recording of the raster data B1-r1 to B1-r9 of the preceding second image B1 is performed, the pattern 20-7 is to be detected by the detection unit 15.

As in FIG. 8, when the preceding second image B1 is recorded at a desired position of the second surface P2, as described above, in a case in which the pattern 20-7 is detected in the detection unit 15, recording of the raster data B1-r4 to B1-r12 is supposed to be performed, and thus the raster data r being recorded by the recording unit 6 is deviated by three lines.

In a case of FIG. 9, the control unit 10, when the preceding second image B1 (second image B) is recorded on the second surface P2, (negatively) determines that the reference pattern 20 detected by the detection unit 15 and the raster data r of the second image B recorded by the recording unit 6 when the reference pattern 20 is detected do not match the second correspondence relationship.

As described above, the control unit 10 generates the first correspondence relationship that associates the reference pattern 20 with the raster data of the first image A in the medium transport direction Y, and the second correspondence relationship that associates the reference pattern 20 with the raster data of the second image B in the medium transport direction Y. When the second image B is recorded on the second surface P2, the control unit 10 performs the determination processing for determining whether the reference pattern 20 detected by the detection unit 15 and the raster data r of the second image B recorded by the recording unit 6 when the reference pattern 20 is detected match the second correspondence relationship. In a case of "negatively" determining in this "determination processing", the control unit 10 can determine that the position of the second image B being recorded on the second surface P2 is deviated with respect to the first image A recorded on the first surface P1.

In this determination processing, since when one pattern of the reference patterns 20 is detected, whether the position of the second image B is deviated with respect to the first image A or not can be determined, a possibility that a reading error occurs can be reduced compared to a method for detecting the positional deviation of the second image B with respect to the first image A by reading intervals between the plurality of patterns, for example, and thus the position deviation can be detected with high precision.

Note that, "a match" in the determination processing is not limited to a case in which when the second image B is recorded on the second surface P2, the reference pattern 20 detected by the detection unit 15 and the raster data r of the second image B, which the recording unit 6 records when the reference pattern 20 is detected, completely match the second correspondence relationship.

The number of lines of the raster data of the image increases as resolution is enhanced. When the resolution of the image is high, deviation of the raster data as plus or minus several lines does not appear as visible deviation of the image in some cases. In such a case, a configuration may be adopted in which the deviation of the raster data r of the second image B as plus or minus several lines is tolerated, and it is determined that the raster data matches the correspondence relationship.

About Correction Control Performed by Control Unit

Additionally, the control unit 10, when "negatively" determining in the "determination processing", that is, when determining that, in a case that the second image B2 is recorded on the second surface P2, the reference pattern 20 detected by the detection unit 15, and the raster data r of the second image B2, which the recording unit 6 records when the reference pattern 20 is detected, do not match the second correspondence relationship, can perform "correction control" for correcting a positional relationship between the first image A and the second image B.

The case in which the control unit 10 "negatively" determines in the "determination processing" means that the second image B on the second surface P2 is deviated with respect to the first image A on the first surface P1.

Based on a result of the "determination processing" capable of detecting the position deviation of the second image B with respect to the first image A with high precision, the control unit 10 performs "correction control" for correcting the positional relationship of the first image A and the second image B, and thus position matching of the second image B with respect to the first image A can be performed with high precision.

"Correction control" by the control unit 10 can be performed, based on a deviation amount of the raster data r of the second image B from the second correspondence relationship at a timing in which the control unit 10 performs the "determination processing", by complementing or thinning the raster data r of the second image B.

For example, in FIG. 9, as described above, the raster data r of the preceding second image B1 being recorded by the recording unit 6 (raster data B1-r1 to B1-r9) are deviated by three lines from the raster data r (raster data B1-r4 to B1-r12) when recording at a desired position determined based on the second correspondence relationship (FIG. 8) is performed. This is the deviation amount of the raster data r of the second image B from the second correspondence relationship at the timing in which the "determination processing" is performed.

In FIG. 9, since the three lines of the raster data r are recorded with a delay, three lines of the remaining raster data r (raster data B1-r10 to B1-r20) are thinned and recording is performed. Accordingly, deviation between the rear end EA1 of the preceding first image A1 and the rear end EB1 of the preceding second image B1 can be reduced.

When the deviation of the raster data r of the second image B from the second correspondence relationship at the timing in which the "determination processing" is performed precedes the first image A, based on the deviation amount of the raster data r of the second image B from the second correspondence relationship at the timing in which the "determination processing" is performed, by complementing the raster data r of the second image B (e.g., by recording an identical raster data a plurality of times), the deviation between the rear end EA1 of the preceding first image A1 and the rear end EB1 of the preceding second image B1 can be reduced.

By performing the above "correction control", the deviated positional relationship between the first image A and the second image B can easily be corrected.

Additionally, the control unit 10, based on the deviation amount of the raster data r of the second image B from the second correspondence relationship at the timing in which the "determination processing" is performed, can also perform "correction control", by changing a transport amount of the medium P by the transport unit 2 for transporting the medium P.

In FIG. 9, as described above, since the raster data r of the second image B is recorded with a delay with respect to desired recording (second correspondence relationship), by increasing the transport amount of the medium P, the deviation between the rear end EA1 of the preceding first image A1 and the rear end EB1 of the preceding second image B1 can be reduced.

Conversely, when the raster data r of the second image B is recorded in advance with respect to the desired recording (second correspondence relationship), by reducing the transport amount of the medium P, the deviation between the rear end EA1 of the preceding first image A1 and the rear end EB1 of the preceding second image B1 can be reduced.

As described above, based on the deviation amount of the raster data r of the second image B from the second correspondence relationship at the timing in which the "determination processing" is performed, by changing the transport amount of the medium P by the transport unit 2 for transporting the medium P to perform "correction control", the deviated positional relationship between the first image A and the second image B can be easily corrected.

Figure 10:
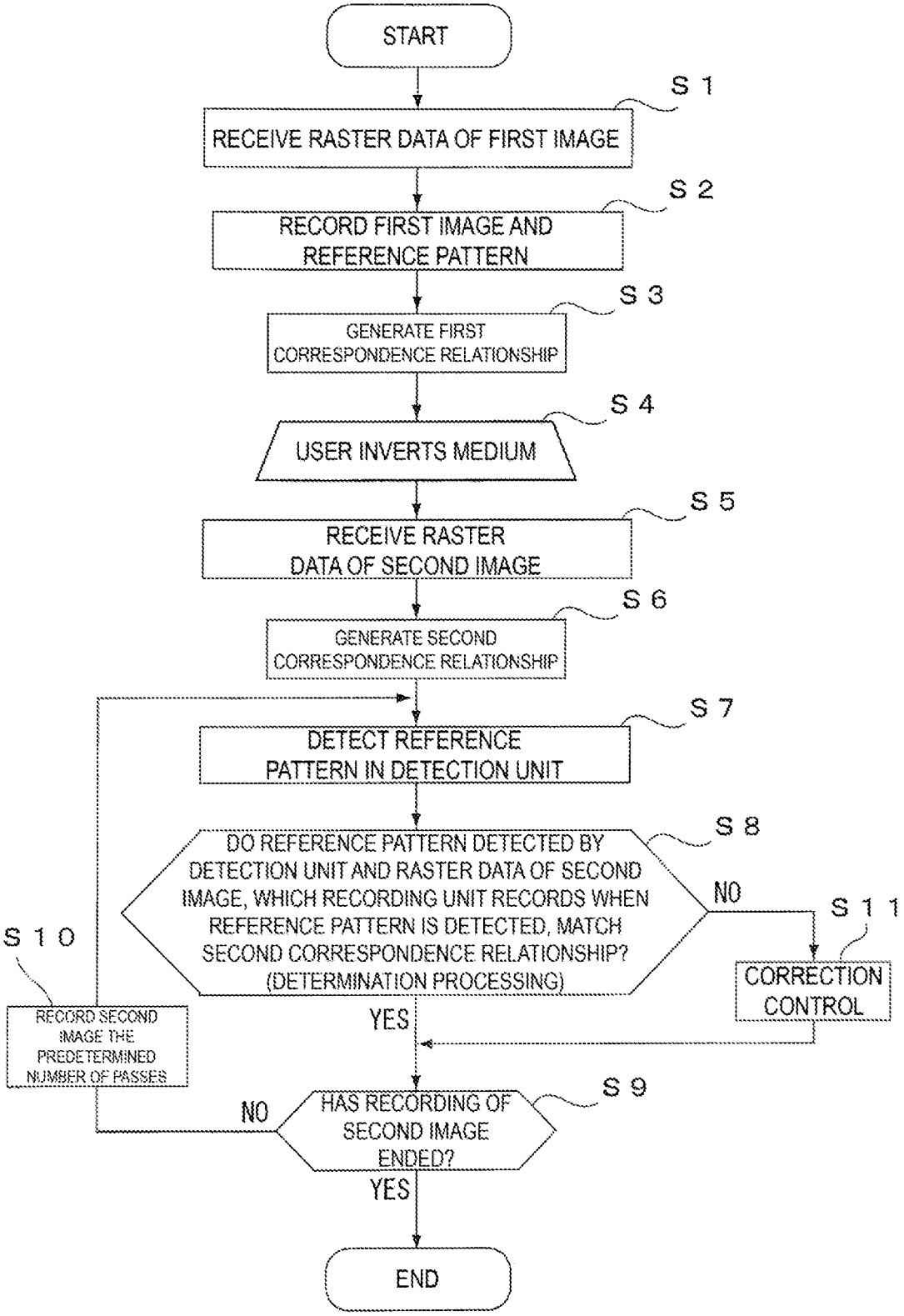
FIG. 10 is a flowchart illustrating control flow of a control unit when duplex recording is performed.

Hereinafter, control performed by the control unit 10 when duplex recording is performed will be described by using a flowchart illustrated in FIG. 10.

When duplex recording is started, the control unit 10 receives the raster data R of the first image A (step S1). Next, the control unit 10 uses the received raster data R of the first image A to record the first image A and the reference pattern 20 on the first surface P1 of the medium P (step S2), and, generates the first correspondence relationship that associates the reference pattern 20 with the raster data of the first image A, in the medium transport direction Y (step S3).

After completion of the recording on the first surface P1, the user inverts the medium P (step S4), and recording on the second surface P2 is started.

The control unit 10 receives the raster data r of the second image B (step S5). Note that, the raster data r of the second image B may be received simultaneously with the raster data R of the first image A in the step S1.

Further, the control unit 10 generates the second correspondence relationship that associates the reference pattern 20 with the raster data of the second image B, in the medium transport direction Y (step S6).

After generating the second correspondence relationship, the control unit 10 detects the reference pattern 20 of the medium P being transported, by the detection unit 15 (step S7), and performs the "determination processing" for determining whether the reference pattern 20 detected by the detection unit 15 and the raster data r of the second image B, which the recording unit 6 records when the reference pattern 20 is detected, match the second correspondence relationship (step S8).

In a case of YES in the step S8, in other words, when the reference pattern 20 detected by the detection unit 15 and the raster data r of the second image B, which the recording unit 6 records when the reference pattern 20 is detected, are determined to match the second correspondence relationship, the processing advances to a step S9. The step S9 will be described later.

Additionally, in a case of NO in the step S8, in other words, when the reference pattern 20 detected by the detection unit 15 and the raster data r of the second image B, which the recording unit 6 records when the reference pattern 20 is detected, are (negatively) determined not to match the second correspondence relationship, the processing advances to a step S11, and after "correction control" is performed, the processing advances to the above-described step S9.

The step S9 is a process for determining whether the control unit 10 completes the recording of the second image B or not. When the recording of the second image B is not completed (step S9: NO), the carriage 8 is moved, the second image B is recorded the predetermined number of passes, and the processing returns to the step S7. When the recording of the second image B is completed (step S9: YES), duplex recording ends.

The flow of a series of controlling processes performed by the control unit 10 when duplex recording is performed has been described thus far.

Note that, as in the exemplary embodiment, since the detection unit 15 is provided at the upstream side of the recording unit 6 in the medium transport direction Y, the position deviation between the first image A and the second image B can be detected earlier than a case in which the detection unit 15 is provided at the downstream side of the recording unit 6.

Accordingly, when position deviation of the preceding second surface B1 on the second surface P2 with respect to the preceding first image A1 on the first surface P1 occurs immediately after recording of the preceding second image B1 is started, it is possible to reflect position deviation information obtained by the "determination processing" performed by the control unit 10 on the recording of the preceding second image B1 and perform correction.

Note that, the detection unit 15 can be provided at the downstream side of the recording unit 6 in the medium transport direction.

In this case, the position deviation information (deviation amount) of the preceding second image B1 on the second surface P2 with respect to the preceding first image A1 on the first surface P1 can be used for correction when the following second image B2 is recorded.

In other words, the first image A contains the preceding first image A1 recorded in advance and the following first image A2 recorded following the preceding first image A1, and the second image B contains the preceding second image B1 for which the recording position is determined with respect to the preceding first image A1 and which is recorded in advance, and the following second image B2 for which the recording position is determined with respect to the following first image A2 and which is recorded following the preceding second image B1. The control unit 10, when the following second image B2 is recorded, performs "correction control" based on the deviation amount obtained from the result of the "determination processing" when the preceding second image B1 is recorded. Accordingly, a possibility that the following second image B2 is recorded while being deviated with respect to the following first image A2 can be reduced.

Note that, as described above, when the following second image B2 is recorded, "correction control" performed based on the deviation amount obtained from the result of the "determination processing" when the preceding second image B1 is recorded, can also be performed for the printer 1 having a configuration in which the detection unit 15 is provided at the upstream side of the recording unit 6 in the medium transport direction Y.

Additionally, the disclosure is not intended to be limited to the aforementioned exemplary embodiment, and many variations are possible within the scope of the disclosure as described in the appended claims. It goes without saying that such variations also fall within the scope of the disclosure.

For example, a recording device according to the present disclosure is not limited to a recording device for recording on fabric as the medium P, but also may be a recording device for recording on recording paper as the medium P (either roll paper or cut paper is usable).

Further, for example, the first image A and the reference pattern 20 can be recorded on the first surface P1 of the medium P by another printer other than the printer 1 (referred to as another printer in the following), and the second image B can be recorded on the second surface P2 by the printer 1.

In this case, a table of the first correspondence relationship associating the reference pattern 20 and the raster data R of the first image A included in the other printer may be input to the printer 1, and when the printer 1 records the second image B on the second surface P2, the control unit 10 may generate the second correspondence relationship based on the input first correspondence relationship and perform the determination processing. According to the present disclosure, even when a printer for recording the first image A and the reference pattern 20 on the first surface P1 differ from a printer for recording the second image B on the second surface P2, deviation between the position of the first image A recorded on the first surface P1 and the position of the second image B recorded on the second surface P2 can be suppressed.

Additionally, a configuration may be adopted in which the printer 1 is provided with a scanner, and scans the first image A and the reference pattern 20 on the first surface P1 that are recorded by the other printer, and the control unit 10 generates the first correspondence relationship.

This application claims priority under 35 U.S.C. § 119 to Japanese Patent Application No. 2018-063854, filed Mar. 29, 2018. The entire disclosure of Japanese Patent Application No. 2018-063854 is hereby incorporated herein by reference.

What is claimed is:

1. A recording device configured to perform recording on both a first surface of a medium to be transported, and a second surface being an opposite surface to the first surface, the recording device comprising:

a recording unit configured to perform the recording on the medium;

a detection unit configured to detect, when the recording unit records a second image on the second surface, a reference pattern formed on the first surface when the recording unit records a first image on the first surface, wherein the reference pattern includes a plurality of patterns formed at specific intervals on the first surface in a medium transport direction; and a control unit configured to:

control the recording unit;

generate a first correspondence relationship that associates each pattern of the plurality of patterns formed on the first surface with a corresponding set of lines of a first plurality of lines included in raster data of the first image in the medium transport direction;

generate a second correspondence relationship that associates each pattern of the plurality of patterns formed on the first surface with a corresponding set of lines of a second plurality of lines included in raster data of the second image in the medium transport direction; and when the second image is recorded on the second surface, perform determination processing for determining whether the plurality of patterns on the first surface detected by the detection unit and the raster data of the second image match the second correspondence relationship, wherein the recording unit is further configured to perform the recording of the second image on the second surface of the medium when a pattern of the plurality of patterns is detected on the first surface.

2. The recording device according to claim 1, wherein the detection unit is provided upstream of the recording unit in the medium transport direction.

3. The recording device according to claim 1, wherein the control unit is configured to, in the determination processing, when the second image is recorded on the second surface, and determination is made that the reference pattern detected by the detection unit and the raster data of the second image, which the recording unit records when the reference pattern is detected, do not match the second correspondence relationship, perform correction control correcting a positional relationship between the first image and the second image.

4. The recording device according to claim 3, wherein the correction control is performed by the control unit complementing or thinning the raster data of the second image, based on an amount of deviation of the raster data of the second image from the second correspondence relationship when the determination processing is performed.

5. The recording device according to claim 4, wherein the first image includes a preceding first image which is recorded first, and a following first image which is recorded following the preceding first image, the second image includes a preceding second image for which a recording position is determined with respect to the preceding first image and which is recorded first, and a following second image for which a recording position is determined with respect to the following first image and which is recorded following the preceding second image, and the control unit is configured to, when the following second image is recorded, perform the correction control, based on the amount of deviation obtained from a result of the determination processing when the preceding second image is recorded.

6. The recording device according to claim 3, further comprising:

a transport unit configured to transport the medium, wherein the correction control is performed by the control unit changing an amount of transport of the medium by the transport unit, based on an amount of deviation of the raster data of the second image from the second correspondence relationship at a timing in which the determination processing is performed.

7. The recording device according to claim 3, wherein the control unit is configured to calculate an amount of deviation, and the amount of deviation corresponds to a count of lines of the second plurality of lines by which the raster data of the second image is deviated from the second correspondence relationship at a time when the determination processing is performed.

8. The recording device according to claim 1, comprising:

a support unit configured to support the medium at a position facing the recording unit, wherein the detection unit is provided at a side of the support unit.

* * * * *